United States Patent [19]

Frates et al.

[11] Patent Number: 4,724,899

[45] Date of Patent: Feb. 16, 1988

[54] EXPANDABLE INSERT FOR A HEAT EXCHANGER

[75] Inventors: Paul S. Frates; David J. Byerly, both of Lawrenceville, Ga.; William S. Blair, Jr., Franklin, N.C.

[73] Assignee: Nordson Corporation, Westlake, Ohio

[21] Appl. No.: 941,412

[22] Filed: Dec. 16, 1986

[51] Int. Cl.[4] ..... F28F 1/40

[52] U.S. Cl. ..... 165/76; 165/179; 165/177; 138/38

[58] Field of Search ..... 165/177, 179, 181, 76; 138/38, 40

[56] References Cited

U.S. PATENT DOCUMENTS

| | | | |
|---|---|---|---|
| 600,910 | 3/1898 | Elmendorf . | |
| 2,230,221 | 2/1941 | Fitch | 263/20 |
| 2,394,831 | 2/1946 | Woods | 165/76 |
| 2,726,681 | 12/1955 | Gaddis et al. | 138/38 |
| 2,731,709 | 1/1956 | Gaddis et al. | 29/157.3 |
| 2,895,508 | 6/1959 | Drake | 138/38 |
| 3,310,843 | 3/1967 | Mancuso | 18/30 |
| 3,871,407 | 3/1975 | Bykov et al. | 138/38 |
| 4,419,802 | 12/1983 | Riese | 165/179 |
| 4,437,581 | 3/1984 | Coker | 222/54 |

FOREIGN PATENT DOCUMENTS

| | | | |
|---|---|---|---|
| 484937 | 3/1917 | France | 138/38 |
| 15087 | of 1903 | United Kingdom | 138/38 |

*Primary Examiner*—Charles J. Myhre
*Assistant Examiner*—Sue Hagarman
*Attorney, Agent, or Firm*—Wood, Herron & Evans

[57] ABSTRACT

A heat exchanger includes an insert having a plurality of longitudinal flutes disposed about its periphery defining flow passages of enhanced surface area. The insert includes at least one slot and expansion means so that the insert can be inserted into a duct without press fitting and subsequently expanded to urge the flutes into intimate thermal contact with the wall of the duct. Removal of the expanding force permits the insert to be removed from the duct for maintenance.

9 Claims, 4 Drawing Figures

EXPANDABLE INSERT FOR A HEAT EXCHANGER

FIELD OF THE INVENTION

The present invention relates to heat exchangers for use in heating flowable materials such as adhesives, and other coatings which are heated prior to application to a workpiece. The heat exchanger is of the type wherein a duct carrying the material includes an internal member in thermal contact with both the material and the wall of the duct for improving heat transfer therebetween.

BACKGROUND OF THE INVENTION

Many materials such as adhesives must be heated in order to bring them to the proper viscosity for application to a substrate. For instance, in a hot-melt adhesive dispensing system, solid adhesive material is melted in a heated tank and distributed in liquid form to one or more remote dispensing guns through a duct in a manifold block. The manifold block is heated to keep the adhesive in a flowable, liquid state. To increase the rate of heat transfer from the manifold block to the adhesive, it has been proposed to press fit an insert of thermally conductive material into the duct. The press fit insures intimate mechanical and hence, thermal contact between the wall of the duct and the insert. The insert includes a plurality of longitudinal flutes disposed about its periphery which divide the duct into a series of passageways thereby increasing the heated surface area in contact with the adhesive.

Heat exchangers incorporating inserts for providing increased surface area are well known. For example, U.S. Pat. Nos. 2,726,681 and 2,731,709 to Gaddis et al. describe an internally finned heat exchanger tube and method of making the same whereby a plurality of channel members are temporarily secured at their base to a polygonal supporting rod. The assembly is then fitted into a tube and the supporting rod is removed. The channel members are bonded to the inner wall of the tube by copper brazing. Brazing secures member to the tube with little thermal resistance, but is undesirable from a production standpoint. Brazing is relatively slow, subject to high scrap rates and requires special equipment for heating and proper flux removal afterward. It is also difficult to braze inside a massive member such as a manifold block since considerable heat input is required. Unless performed in an inert atmosphere and depending on the material used, brazing can result in the formation of thermally insulating oxides and may necessitate subsequent heat treating to relieve stresses or restore metallurgical properties. Once brazed, the insert is permanent and cannot be easily removed. This is a serious drawback in applications where it may be necessary to remove the insert for cleaning or unclogging.

U.S. Pat. No. 2,895,508 to Drake shows an insert having a plurality of radially extending legs terminating in foot portions. The insert is force fitted into a tube to bring the feet into intimate mechanical contact with the inner wall of the tube. The insert may deform elastically for a resilient fit or the interference may be such that the feet and tube will cut into one another. A similar arrangement is shown in U.S. Pat. No, 3,871,407 to Bykov et al. which discloses forming the ribs of an insert as wedges having pointed ends which displace the wall of a tube into which the insert is press fitted thereby improving thermal conductivity.

Press fit techniques are troublesome because they require close tolerances. Too much interference can result in galling or cracking the insert or tube while too little interference produces a poor thermal joint. Even with proper tolerances, it is often difficult to apply sufficient force to press fit an insert of significant length. Another problem with press fitting is that, like brazing, the insert is permanently installed and cannot be removed without considerable difficulty. Further, press fits which displace metal can also weaken the tube to a degree which is not easy to predict or control. This can be a serious problem where high operating pressures are involved or where the heat exchanger must contain hazardous materials.

Accordingly, there exists a need for a heat exchanger having an insert which can be installed in a duct easily without requiring a large insertion force and without galling or otherwise compromising the structural integrity of the insert or the duct. Further, there is a need for such a heat exchanger having an insert which provides good thermal contact between the insert and the duct without brazing or welding. There further exists a need for a heat exchanger including an insert which, following installation in a duct, can be easily removed as required for maintenance.

SUMMARY OF THE INVENTION

The present invention is predicated upon the concept of providing an expandable insert for a heat exchanger which is easily inserted into a duct and subsequently expanded to urge the insert into intimate contact with the inner wall of the duct. The insert is thereby secured within the duct in a manner providing good thermal conductivity between the two parts without need of brazing, welding or close tolerance press fits. As used herein and in the claims, the term "duct" refers to a duct, pipe, tube, conduit or other structure adapted to carry flowable material.

In a preferred embodiment, the insert of the invention comprises an extruded body having a series of outwardly extending peripheral flutes defining flow passages for the fluid. The insert body has a pair of parallel longitudinal slots extending a substantial portion of the length of the body from each of its ends to permit the body to expand. The insert body further includes an axial bore having an outwardly tapered section at each end communicating with one of the slots. The tapered sections of the axial bore each receive a mating tapered plug which are drawn together to expand the slots and, hence, the insert body itself by means of a bolt passing through the bore and each tapered plug. Once installed in a duct, the insert is readily removed for maintenance by loosening the bolt to remove the expanding force.

These and other advantages will be apparent from the following detailed description of a preferred embodiment of the invention and from the accompanying drawings wherein like reference numerals designate like items.

DETAILED DESCRIPTION OF THE INVENTION

Figure 1:
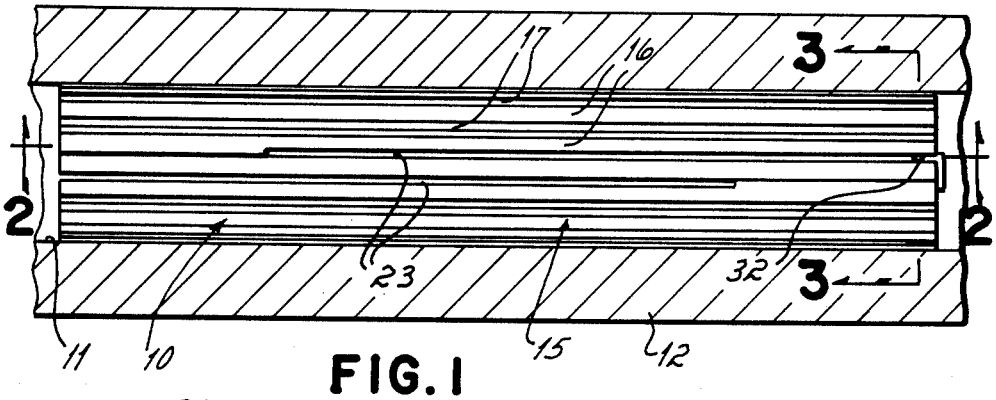
FIG. 1 is an elevational view illustrating a preferred embodiment of an insert for a heat exchanger according to the invention shown installed in a duct within a manifold block.
Figure 2:
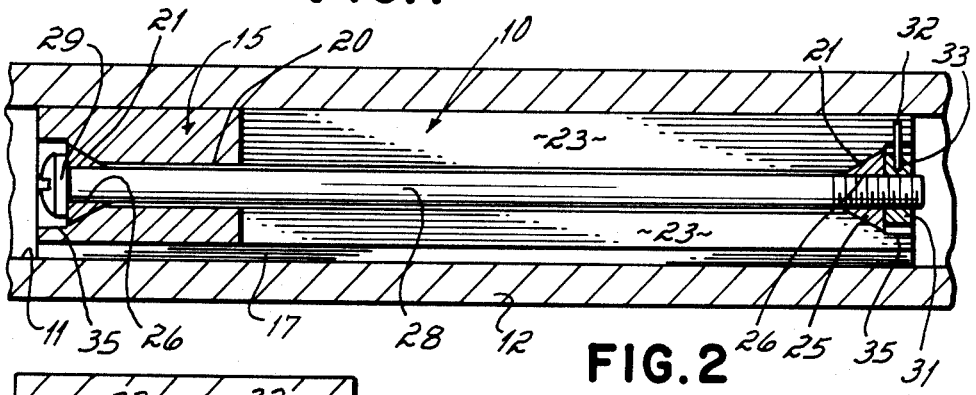
FIG. 2 is a cross-sectional view taken along line 2—2 of FIG. 1.
Figure 3:
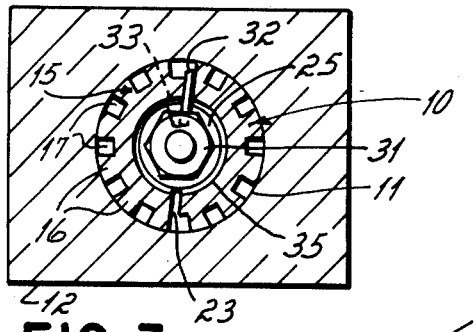
FIG. 3 is an cross-sectional view taken along line 3—3 of FIG. 1.
Figure 4:
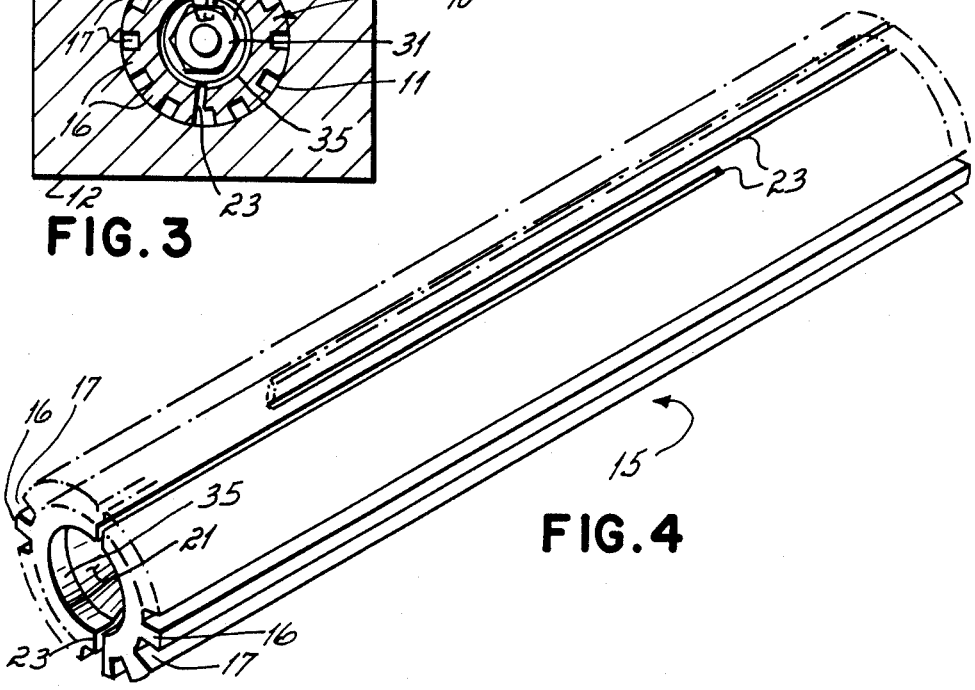
FIG. 4 is a perspective view further illustrating the body of the insert for a heat exchanger of FIGS. 1, 2 and 3 with only several flutes shown to more clearly show the slots.

Referring now to the drawings, there is shown a preferred embodiment of an expandable insert 10 for a heat exchanger according to the present invention. For purposes of illustration, insert 10 is shown in FIGS. 1, 2 and 3 installed in a duct 11 of a manifold block 12 in a hot-melt adhesive dispensing system. In such a system, molten adhesive is pumped through duct 11 to be carried through hoses (not shown) from the manifold block 12 to one or more dispensing guns (also not shown). To maintain the adhesive in a flowable liquid state, manifold block 12 is heated by virtue of its contact with an adhesive melting tank (not shown) having an electrical heater. To enhance the transfer of heat from manifold block 12 to the adhesive, duct 11 is fitted with insert 10 to increase the heated surface area in contact with the adhesive. Insert 10 is itself heated by thermal conduction from manifold block 12.

Insert 10 includes an elongated body 15 having generally cylindrical shape. When in an unexpanded condition, body 15 is slightly smaller in overall diameter than the internal diameter of duct 11. Body 15 includes a plurality of longitudinal ribs or flutes 16, the spaces between which define a series of passageways 17 for adhesive. Preferably, body 15 is fabricated from an extrusion of thermally conductive material such as aluminum alloy or other material selected to be compatible with the material of a manifold block 12. Preferably body 15 and manifold block 12 are of the same aluminum alloy thereby avoiding galvanic corrosion and undue stresses due to differences in thermal expansion.

Body 15 is traversed by an axial bore 20 whose opposite ends include a pair of opposed, outwardly tapered sections 21. Each tapered section 21 communicates with one of a pair of parallel longitudinal slots 23. Each slot 23 preferably extends completely through the cross section of body 15 and extends along a substantial portion of the length of body 15 as shown. Received within each tapered section 21 of axial bore 20 is a matingly tapered plug 25 which includes a central hole 26 aligned with bore 20. A bolt 28 having a slotted head 29 passes through bore 20 and the hole 26 of each tapered plug 25. One tapered plug 25 is retained in its respective tapered section 21 of axial bore 20 by the head 29 of bolt 28 while the other tapered plug is so retained by a hex nut 31 threaded onto the opposite end of bolt 28. Nut 31 is prevented from rotating with respect to body 15 by means of a steel pin 32 pressed into a hole 33 in its side and extending into one of the slots 23 as shown. Both the head 29 of bolt 28 and nut 31 are recessed in counterbores 35 located at opposite ends of the body 15 of insert 10.

In operation, insert 10 is initially in an unexpanded state with bolt 28 and nut 31 loosely retaining tapered plugs 25. Insert 10 is then slid inside the duct 11 of manifold block 12. Prior to doing so, duct 11 and the outermost surface of flutes 16 should be thoroughly cleaned to remove any foreign matter, oxides or the like to insure that good thermal contact will be made between flutes 16 and duct 11. If desired, a thin coating of thermally conductive joint compound can be applied to the outermost surfaces of flutes 16 to further enhance thermal contact.

Once insert 10 is received in a desired position inside duct 11, bolt 28 is tightened using a screwdriver to engage a slot in its head 29. As bolt 28 is tightened, tapered plugs 25 are drawn toward one another. As this occurs, plugs 25 act as wedges exerting an outward force component on each tapered section 21 of axial bore 20, causing each slot 23 to widen. As slots 23 widen, the body 15 of insert 10 is expanded outwardly thereby forcing a sufficient portion of the outer surfaces of flutes 16 into sufficiently intimate thermal contact with the wall of duct 11 in manifold block 12 to provide good thermal conductivity. Since flutes 16 and manifold block 12 are in direct forced contact, the thermal resistance between them will be small. Therefore, heat will be transferred efficiently from manifold block 12 to the body 15 of heat exchanger insert 10 by way of flutes 16. As adhesive is pumped through duct 11, it flows through passageways 17 thereby increasing its area of exposure to heated surface so that the overall rate of heat transfer to the adhesive will be increased.

While the above description constitutes a preferred embodiment of the apparatus of the invention, it is to be understood that the invention is not limited thereby and that in light of the present disclosure of the invention alternative embodiments will be apparent to persons skilled in the art. For example, an operable insert 10 could be constructed having a single slot dividing body 15 into separate pieces. However, it is preferable to keep body 15 in one piece so that insert 10 can be pre-assembled without having to be held together by external means. As a second alternative, body 15 could be provided with one or more slots extending along a substantial portion of its length from the same end, omitting the tapered plug and slot from the opposite end. However, more complete and uniform expansion of body 15 and, hence, better thermal contact with duct 11 is provided by expanding body 15 from both ends as described above.

It must also be noted that while the invention is described with reference to its application in a hot-melt adhesive dispensing system the invention is not limited to such application. To the contrary, the invention can be applied to great advantage in many installations by which it is desired to transfer heat to a material flowing through a thermally conductive duct.

Accordingly, it is to be understood that various changes can be made without departing from the scope of the invention as particularly pointed out and distinctly claimed in the claims set forth below.

What is claimed is:

1. A heat exchanger comprising:

(a) a duct for carrying fluid;

(b) a removable insert for facilitating heat transfer between said duct and the fluid, said insert including an elongated body receivable within said duct, said body having a longitudinal slot and a plurality of flutes disposed about its periphery defining passageways for the fluid, and (c) mechanical expansion means carried by said body for selectively applying an expanding force to said body and removing the expanding force to urge said flutes into intimate thermal contact with said duct when the expanding force is applied and to facilitate removal of said body from said duct when the expanding force is removed.

2. The heat exchanger of claim 1 wherein said expansion means includes wedge means operably engaging said body to widen said slot thereby expanding said body.

3. A heat exchanger, comprising:

(a) a duct for carrying fluid;

(b) an insert for facilitating heat transfer between said duct and the fluid, said insert including an elongated body receivable within said duct and having a plurality of flutes disposed about its periphery defining passageways for the fluid, said body including a longitudinal slot and a tapered bore communicating with said slot;

(c) a tapered plug receivable in said tapered bore, and (d) force generating means for urging said tapered plug into forced engagement with said tapered bore to widen said slot thereby expanding said body and urging said flutes into intimate thermal contact with said duct.

4. The heat exchanger of claim 3 wherein said force generating means comprises a longitudinal bore communicating with said tapered bore and a bolt extending through said longitudinal bore threadably engaging said tapered plug.

5. The heat exchanger of claim 4 wherein said force generating means further comprises a second tapered bore and a second tapered plug, said bolt having a head in engagement with said second tapered plug.

6. In a heat exchanger having a duct for carrying fluid, and insert for facilitating heat transfer between the duct and the fluid, said insert comprising:

(a) an elongated body receivable within the duct, said body having a plurality of flutes disposed about its periphery defining passageways for the fluid, and an axial bore having a pair of outwardly tapered sections, said body also having a pair of longitudinal slots, one of which communicates with each of said tapered sections;

(b) a pair of tapered plugs one of which is received in each of said tapered sections; and (c) a bolt passing through said axial bore and each of said tapered plugs to draw said plugs into forced engagement with said tapered sections to expand said body thereby urging said flutes into intimate thermal contact with the duct.

7. The insert of claim 6 wherein said longitudinal slots overlap one another.

8. The insert of claim 6 wherein said longitudinal slots each extend along a substantial portion of the length of said body.

9. The apparatus of claim 6 wherein said body comprises an extrusion.

* * * * *